US009505053B2

(12) United States Patent
Aspacher et al.

(10) Patent No.: US 9,505,053 B2
(45) Date of Patent: Nov. 29, 2016

(54) CASTING PLUNGER AND CASTING UNIT WITH SHUT-OFF VALVE

(75) Inventors: Ronny Aspacher, Schorndorf (DE); Erich Kuhn, Welzheim (DE); Norbert Erhard, Lorch (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 232 days.

(21) Appl. No.: 14/113,979

(22) PCT Filed: Feb. 27, 2012

(86) PCT No.: PCT/EP2012/053288

§ 371 (c)(1),
(2), (4) Date: Oct. 25, 2013

(87) PCT Pub. No.: WO2012/146408

PCT Pub. Date: Nov. 1, 2012

(65) Prior Publication Data

US 2014/0042193 A1 Feb. 13, 2014

(30) Foreign Application Priority Data

Apr. 27, 2011 (DE) ..... 10 2011 017 610

(51) Int. Cl.
*B22D 17/04* (2006.01)
*B22D 17/20* (2006.01)
*B22D 39/02* (2006.01)

(52) U.S. Cl.
CPC ..... *B22D 17/04* (2013.01); *B22D 17/203* (2013.01); *B22D 17/2015* (2013.01); *B22D 39/02* (2013.01); *B22D 39/023* (2013.01)

(58) Field of Classification Search
CPC B22D 17/04; B22D 17/2015; B22D 39/023; B22D 39/02; B22D 17/203
USPC ..... 222/596, 591, 590, 594; 164/113, 312, 164/316, 337, 335; 425/559, 562, 563, 564
See application file for complete search history.

(56) References Cited

U.S. PATENT DOCUMENTS 5,092,499 A 3/1992 Sodderland
5,350,007 A * 9/1994 Miki ..... B22D 17/203 164/113

(Continued)

FOREIGN PATENT DOCUMENTS

BE 351 505 A 5/1928
DE 44 19 848 C1 12/1995

(Continued)

OTHER PUBLICATIONS

International Search Report dated May 24, 2012 with English translation (six (6) pages).
German-language Office Action Dated Dec. 30, 2011 (four (4) pages).

*Primary Examiner* — Scott Kastler
*Assistant Examiner* — Michael Aboagye
(74) *Attorney, Agent, or Firm* — Crowell & Moring LLP

(57) ABSTRACT

A casting plunger for a casting unit of a casting machine, includes a casting-plunger shut-off valve integrated into the casting plunger, having a valve seat and a valve body interacting therewith, wherein the shut-off valve, in an open position, enables a flow of a melt material through the casting plunger during a melt suction operation and, in a closed position, blocks said flow during a mold-filling operation. The casting plunger has a plunger sleeve, which is placeable against an inner wall of a casting cylinder of the casting unit and contains the valve seat, and a plunger ram which contains the valve body. The plunger sleeve and the plunger ram are movable axially with respect to one another by a predefinable valve stroke.

12 Claims, 6 Drawing Sheets

(56) References Cited

U.S. PATENT DOCUMENTS

| | | | | |
|---|---|---|---|---|
| 5,401,161 | A * | 3/1995 | Long | B29C 45/52 425/563 |
| 5,699,849 | A | 12/1997 | Fink | |
| 7,717,698 | B2 * | 5/2010 | Cosgun | B29C 45/541 425/558 |
| 2002/0056537 | A1 * | 5/2002 | Fink | B22D 17/04 164/113 |
| 2005/0233020 | A1 | 10/2005 | Manda et al. | |
| 2005/0284600 | A1 * | 12/2005 | Ilmonen | B22D 17/203 164/312 |
| 2007/0269550 | A1 | 11/2007 | Manda | |

FOREIGN PATENT DOCUMENTS

| | | | |
|---|---|---|---|
| DE | 199 28 770 | A1 | 8/2000 |
| DE | 10 2009 012 636 | A1 | 9/2010 |
| EP | 1 201 335 | B1 | 5/2006 |
| JP | 8-33971 | A | 2/1996 |
| JP | 2000-117417 | A | 4/2000 |
| JP | 2000-190364 | A | 7/2000 |
| JP | 2001-293553 | A | 10/2001 |
| JP | 2002-336947 | A | 11/2002 |
| JP | 3409154 | B2 | 3/2003 |
| JP | 2007-531854 | A | 11/2007 |

* cited by examiner

Fig. 3
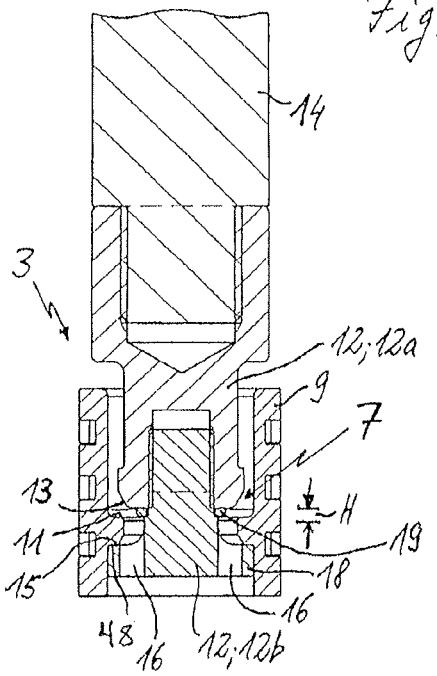
Fig. 4
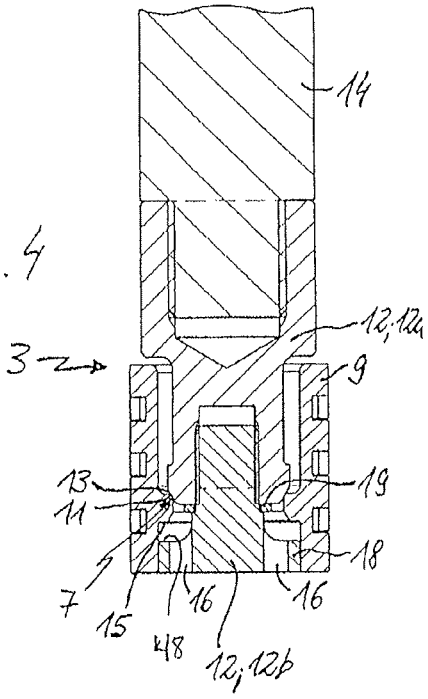
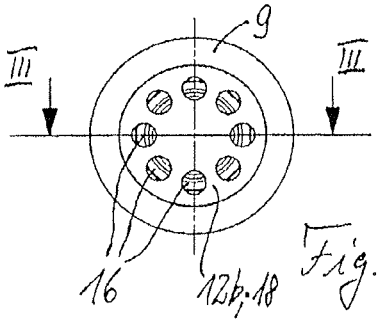
Fig. 5

CASTING PLUNGER AND CASTING UNIT WITH SHUT-OFF VALVE

BACKGROUND AND SUMMARY OF THE INVENTION

The invention relates to a casting plunger having an integrated shut-off valve and to a casting unit, having a casting container, for a casting machine, such as a hot-chamber diecasting machine, wherein the casting unit contains a casting plunger arranged in an axially movable manner in a casting cylinder of the casting container and/or a riser-duct shut-off valve in a riser duct of the casting container. The casting-plunger shut-off valve serves, in an open position, to enable a flow of melt material through the casting plunger during a melt suction operation and, in a closed position, to block said flow during a mold-filling operation. The riser-duct shut-off valve serves, in a closed position, to block a flow of melt material during a melt suction operation and, in an open position, to enable said flow during a mold-filling operation.

The patent publication EP 1 201 335 B1 discloses a casting unit of this kind, wherein a conventional nonreturn valve is proposed both for the casting-plunger shut-off valve and for the riser-duct shut-off valve. The nonreturn valve integrated into the casting plunger opens during the draw-back movement of the casting plunger during a melt suction operation and in this way makes it possible to feed melt material through the casting plunger into a casting chamber which is formed by the casting cylinder itself or an additional cavity in the casting container, while it closes during the mold-filling operation, so that, by way of the advancing movement of the casting plunger, melt material can be pushed out of the casting chamber and into a mold via the riser duct, without flowing back through the casting plunger. The nonreturn valve in the riser duct opens during the mold-filling operation so that melt material can pass out of the casting chamber and into the mold via the riser duct, and closes during the melt suction operation, so that a return flow of melt from the riser duct into the casting chamber on account of a negative pressure arising there and/or of the dead weight of the melt in the riser duct is prevented.

The laid-open specification DE 10 2009 012 636 A1 discloses a casting unit having a casting container for a hot-chamber diecasting machine, which contains a special type of nonreturn valve in the form of a ball valve, which is arranged in the lower region of a riser duct of the casting container. The ball valve contains, as movable valve body, a valve ball that interacts with a corresponding valve seat and is made of a material which has a higher specific weight than a melt material that is used, in particular of a carbide material. Upwardly, the movement of the valve ball is limited by a restraining pin introduced into the riser duct. In the valve portion, the inside diameter of the riser duct is selected to be much greater than the diameter of the valve ball so that the melt material can be fed upwardly around the valve ball in the riser duct when the ball valve is in its open position, in which the valve ball lifts up from its valve seat on account of the feed pressure of the melt material. In addition, said document proposes configuring plunger rings, which are introduced into plunger ring grooves in the casting plunger, such that they provide full axial sealing only in the direction of the pressure force, while, during the melt suction operation, they do not provide full sealing with respect to the negative pressure building up in the casting chamber, and are thus intended to allow any residual melt material to escape between the casting plunger and casting cylinder.

It is an object of the invention to provide a casting plunger and a casting unit of the type mentioned at the beginning, which are structurally and/or functionally improved compared with the abovementioned conventional casting plungers and casting units, in particular with regard to the casting-plunger shut-off valve and/or the riser-duct shut-off valve.

In one aspect, the invention achieves this object by providing a casting plunger for a casting unit of a casting machine, said casting plunger comprising a casting-plunger shut-off valve integrated into the casting plunger, having a valve seat and a valve body interacting therewith, wherein the shut-off valve, in an open position, enables a flow of melt material through the casting plunger during a melt suction operation and, in a closed position, blocks said flow during a mold-filling operation, and further comprising a plunger sleeve, which is placeable against an inner wall of a casting cylinder of the casting unit and contains the valve seat, and a plunger ram which contains the valve body, wherein the plunger sleeve and the plunger ram are movable axially with respect to one another by a predefinable valve stroke.

The casting plunger according to the invention thus comprises said plunger sleeve, which rests against an inner wall of a casting cylinder of the casting unit and contains a valve seat of the casting-plunger shut-off valve, and said specific plunger ram. This characteristic realization of the casting-plunger shut-off valve allows this valve to be closed and opened in a defined manner by the predefinable valve stroke, using the movement, necessary for the melt suction operations and the mold-filling operations, of the casting plunger. In this case, the plunger sleeve can be carried along by the movement of the plunger ram, which to this end is driven in the corresponding axial back and forth movement in a conventional manner, for example by means of a plunger rod, leaving the defined valve clearance.

In a development of this casting plunger, the valve stroke for the integrated shut-off valve is settable in a variable manner. Thus, depending on the requirements and application, account can be taken of different circumstances, for example in order to ensure that, depending on the melt material that is used and depending on the structural design and dimensioning or geometry that are used of the casting cylinder and casting plunger, sufficient melt material can always pass through the casting plunger.

In a development of the casting plunger, the plunger ram has a first ram part which contains the valve body, and a second ram part, arranged on the first ram part, which contains a plunger sleeve driver stop. By way of the plunger sleeve driver stop, the plunger sleeve is carried along by an axial movement of the second ram part in at least one of the two opposite axial directions. In a further configuration of the invention, the second ram part is fastenable to the first ram part with the plunger sleeve driver stop at a variably settable axial distance from the valve body, with the result that the valve stroke is variably settable in a corresponding manner.

In a further configuration of the invention, the second ram part contains a disk body or cylinder body which is provided with a plurality of axial melt passage openings and on which the plunger sleeve driver stop can also be formed.

In a further aspect of the invention a casting unit is equipped with a casting plunger according to the invention.

Another casting unit according to the invention comprises especially a riser-duct shut-off valve having a valve body which is introduced in an axially movable manner into the riser duct and is supported in this case against a riser-duct inner wall, wherein said valve body contains a duct structure, extending between opposite axial end sides, for axially passing through melt material, and one of the two axial end sides of the valve body interacts with a valve seat of the shut-off valve. The riser-duct shut-off valve realized in this way makes it possible for melt material to flow through the valve body itself, thereby avoiding any disadvantages which can occur in the case of forced flowing around of a valve body through which flow cannot take place, for example a solid valve ball. Furthermore, on account of this realization of the riser-duct shut-off valve, the pressure conditions at this valve and as a result the intended functionality thereof can be significantly improved in particular even in the case of a passive valve design.

In an advantageous development of this casting unit, the valve body of the riser-duct shut-off valve is cylindrical and that axial end side of the valve body that is remote from the valve seat ends with an end-side stop ring which defines an axial mouth opening of the duct structure and interacts, in a manner limiting the valve stroke, with a corresponding annular shoulder of the riser-duct inner wall. This characteristic valve-body design allows in particular a significant improvement in valve behavior on account of minimized back pressure of melt material located above the valve in the riser duct. In contrast for example to a conventional nonreturn valve having a valve ball body, in which, as a result of pressure equalization of the forces acting from below and above on the valve ball, the valve ball drops onto its valve seat and closes the valve when, towards the end of a mold-filling operation, a relatively large volume of melt material no longer flows through the valve, the present valve can also be kept open in this situation by the pressure force of the melt, in order to deliver a small volume of melt as may be desired for material compaction in the mold during the solidification phase at the end of the mold-filling operation. Only when the pressure is relieved does the riser-duct shut-off valve realized in this way close.

In a further configuration, a diameter of the axial mouth opening is at least approximately as large as a riser-duct diameter reduced by the annular shoulder. This measure favors the above-mentioned functionality, of keeping the riser-duct shut-off valve open by means of the melt pressure, even when no or only a very small volume of melt material is flowing.

In a development of the invention, the duct structure of the valve body of the riser-duct shut-off valve has a plurality of axial duct slots arranged in a manner distributed around the outer circumference of the valve body, said duct slots extending from that axial end side of the valve body that faces the valve seat and ending at a distance from the end-side stop ring and being connected there to the axial mouth opening via a respective radial through-passage opening. This duct structure can be realized with relatively little structural complexity and favors the through-flow behavior of the valve body with melt material and also the above-mentioned valve behavior with regard to opening under pressure even with an otherwise little flow of melt material.

In a development of the invention, the casting-plunger shut-off valve and/or the riser-duct shut-off valve is designed as a passively operating nonreturn valve or alternatively as an actively controllable valve, wherein the valve may be in particular a pneumatically, hydraulically, electromechanically or electromagnetically controllable valve.

Advantageous embodiments of the invention are illustrated in the drawings and described in the following text.

BRIEF DESCRIPTION OF THE DRAWINGS

In the drawings:

FIG. 3 shows a sectional view of the casting plunger in the shut-off valve position in FIG. 1 along a line III-III in FIG. 5, FIG. 4 shows a view of the casting plunger corresponding to FIG. 3 in the shut-off valve position in FIG. 2, FIG. 5 shows a view from beneath of the casting plunger in FIGS. 3 and 4.

DETAILED DESCRIPTION OF THE DRAWINGS

Figure 1:
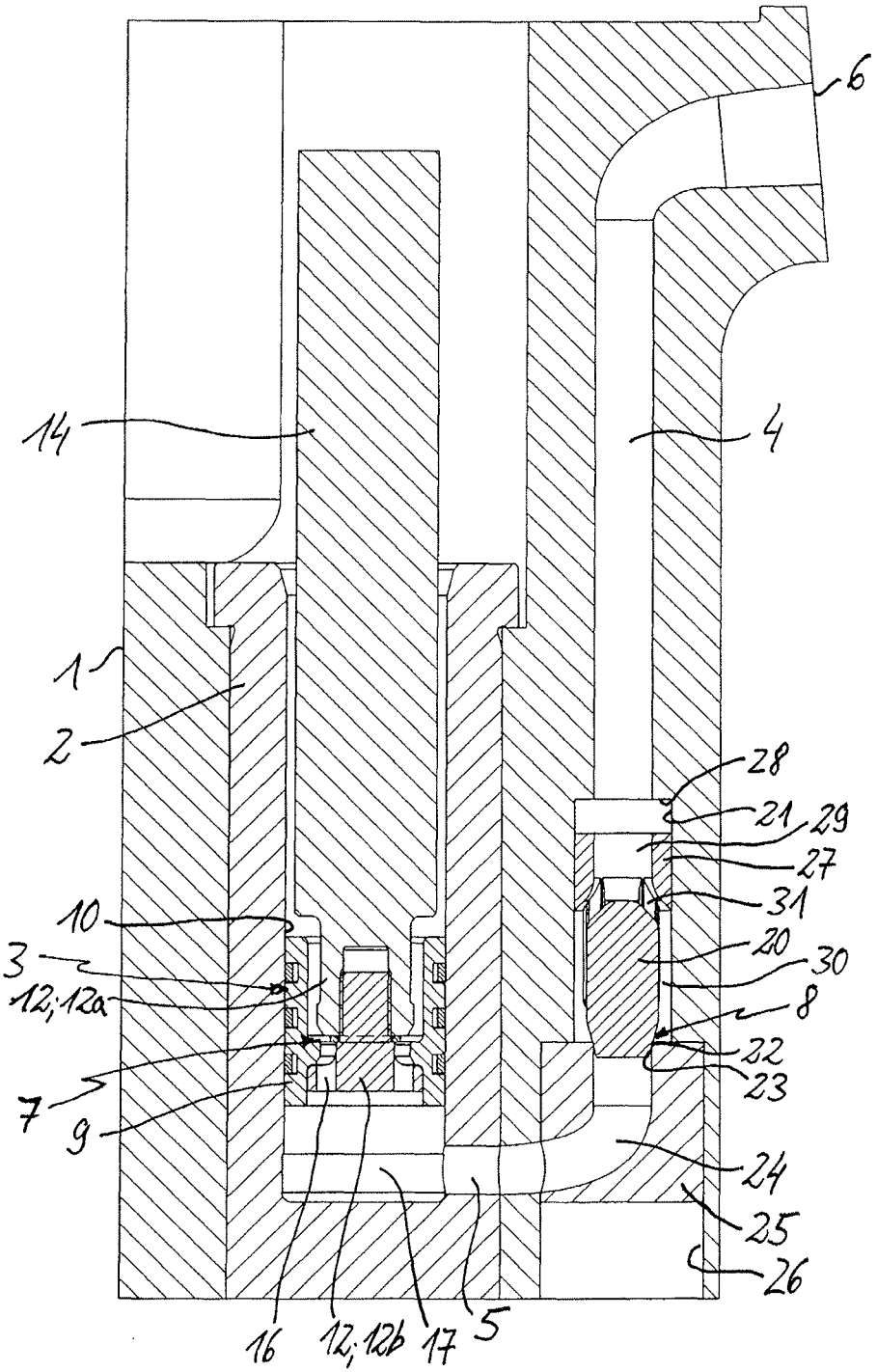
FIG. 1 shows a longitudinal sectional view through a casting unit for a hot-chamber diecasting machine with in each case one shut-off valve in a casting plunger and a riser duct in a melt suction position.
Figure 2:
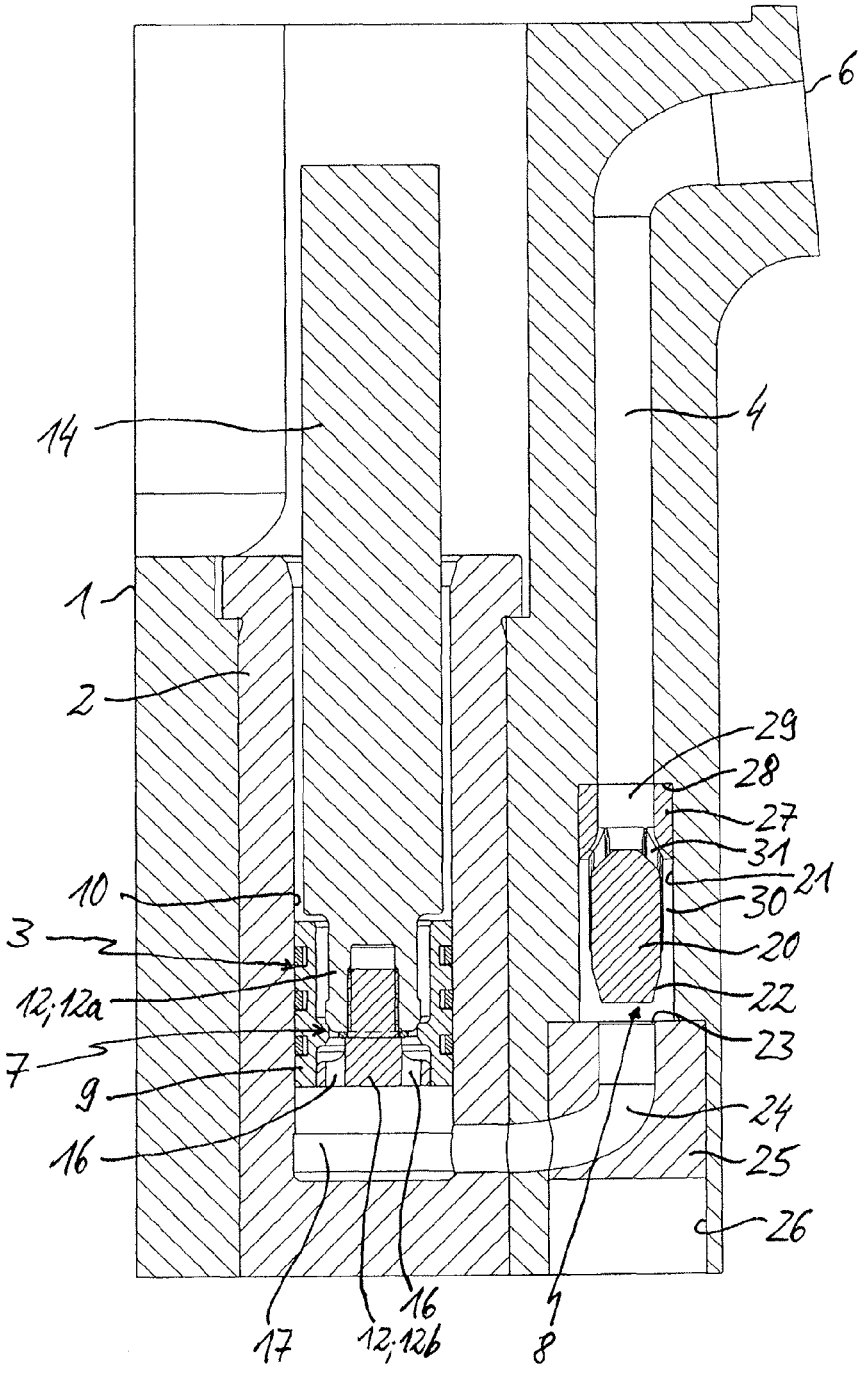
FIG. 2 shows a sectional view corresponding to FIG. 1 in a mold-filling position of the valves.

The casting unit shown in FIGS. 1 and 2 has a conventional structure for use in a hot-chamber diecasting machine, having a casting container 1, in which a casting cylinder 2 is located. A casting plunger 3 is arranged so as to be axially movable back and forth in the casting cylinder 2. Next to the casting cylinder 2, the casting container 1 has a riser duct 4 which extends upwardly from a lateral mouth 5, close to the bottom, of the casting cylinder 2 as far as a riser-duct mouth 6 which is adjoined in a conventional manner (not shown) by a mouthpiece leading to a mold or a corresponding mouthpiece nozzle. Beyond this conventional structure, the casting plunger 3 has a special casting-plunger shut-off valve 7 integrated in it, and a special riser-duct shut-off valve 8 is introduced into the riser duct 4.

As is more clearly apparent in conjunction with FIGS. 3 and 4, in order to realize the integrated shut-off valve 7, the casting plunger 3 has a special structure with a plunger sleeve 9 which rests in a sealing manner against an inner wall 10 of the casting cylinder 2 and contains a valve seat 11, and with a plunger ram 12 which contains a valve body 13. The designations valve seat 11 and valve body 13 are in this case arbitrary and only intended for a distinguishable designation of these two valve elements which form the actual shut-off valve 7 and to this end are axially movable relative to one another between an open position and closed position. Preferably, linear touching contact in the closed position, typically along a circular line, is provided for the two valve elements 11, 13 by corresponding shaping of the latter. Alternatively, designs with flat touching contact of the two interacting valve elements 11, 13 in their closed position can be used. The plunger ram 12 has a first ram part 12*a*, which forms the valve body 13 at its axial end face, and a second ram part 12*b*, fastened to the first ram part 12*a* for example by means of a screw connection, a plunger sleeve driver stop 48 being formed on said second ram part 12*b*. The first ram part 12*a* can be formed in one piece with an associated plunger rod 14 or, as shown in FIGS. 3 and 4, be fixed to the latter for example by means of a screw thread. The plunger sleeve driver stop 48 interacts with a corresponding counter-stop 15 which is formed on the plunger sleeve 9 such that, during the drawback movement, the plunger sleeve 9 is carried along by the second ram part 12*b*. In the reverse advancing movement, the plunger sleeve 9 is carried along by the first ram part 12*a* via the valve closing contact of the valve seat 11 and valve body 13.

The structure explained above thus realizes a passively operating nonreturn valve for optionally enabling and blocking a flow of melt material through the casting plunger. To this end, the second ram part 12*b* has a plurality of axial melt passage openings 16 via which melt material, which has passed the valve gap between the valve seat 11 and valve body 13 with the valve 7 opened, is passed on into the following free space, acting as a casting chamber 17, of the casting cylinder 2. In the example shown, as can be seen from FIG. 5, by way of example eight such melt passage openings 16 are provided in a manner distributed equidistantly in the circumferential direction in the second ram part 12*b*, specifically through a disk body or cylinder body 18 formed by the latter.

The functionality of the casting-plunger shut-off valve 7 can be seen from the two valve end positions as are illustrated in FIGS. 1 to 4. FIGS. 1 and 3 show the valve 7 during a melt suction operation, in which the casting plunger 3 is drawn back by the plunger rod 14 in order to suck melt out of a conventional melt crucible or melt bath (not shown here) into the casting cylinder 2 behind the casting plunger 3 and through the casting plunger 3 into the casting chamber 17. The drawback movement of the plunger rod 14 initially causes the shut-off valve 7 to be opened, if it was previously closed, in that the plunger rod 14 draws back the plunger ram 12 and thus the valve body 13, while the plunger sleeve 9 remains stationary on account of its resting in a pressing and sealing manner against the casting cylinder inner wall 10. Only when the plunger sleeve driver stop 48 of the plunger ram 12 comes into abutment against the corresponding counter-stop 15 of the plunger sleeve 9, on account of this relative movement of the plunger ram 12 by a predefinable valve stroke H with respect to the plunger sleeve 9, is the plunger sleeve 9 carried along by the drawback movement of the plunger ram 12. The shut-off valve 7 is then in its open position, and so melt material can flow through the casting plunger 3, specifically through the annular space between the first ram part 12*a* and plunger sleeve 9, through the valve gap between the valve seat 11 and valve body 13 and through the passage openings 16 in the second ram part 12*b*.

FIGS. 2 and 4 show the shut-off valve 7 in its closed position, as is the case during a mold-filling operation, in which, on account of the forward movement of the plunger rod 14 and of the casting plunger 3, melt material is pressed out of the casting chamber 17 and into a mold via the riser duct 4. During this forward movement of the plunger rod 14, initially the plunger sleeve 9 supported closely against the casting cylinder inner wall 10 again remains at rest until the valve body 13 formed by the axial end face of the first ram part 12*a* has moved forward as far as the valve seat 11 on the plunger sleeve 9 and as a result the shut-off valve 7 assumes its closed position in which it prevents a further flow of melt through the casting plunger 3 into the casting chamber 17. By way of the bearing contact of the first ram part 12*a* against the valve seat 11 of the plunger sleeve 9, the plunger ram 12 then carries the plunger sleeve 9 along in its advancing movement.

The valve stroke H is settable in a variable manner in that the second ram part 12*b* is fixable to the first ram part with its plunger sleeve driver stop 48 at a variably settable distance from the first ram part 12*a* or the valve body 13 thereof, for example in that the second ram part 12*b* is screwed to a greater or lesser extent into the first ram part 12*a*. By selecting a corresponding spacer ring 19, which is inserted between the two ram parts 12*a*, 12*b*, it is possible to determine how far the second ram part 12*b* is screwable into the first ram part 12*a*. In addition, the spacer ring 19 contributes to securely holding the second ram part 12*b* on the first ram part 12*a*. The dimensioning of the valve stroke H can be selected, just like the design and dimensioning of the valve seat 11 and the corresponding valve body 13, such that an optimal flow behavior of melt material flowing through is achieved, in particular a melt flow which is as free of turbulence as possible.

The riser-duct shut-off valve 8 contains a valve body 20 which is introduced in an axially movable manner into the riser duct 4 and is supported against an inner wall 21 of the riser duct 4. The valve body 20 has a duct structure, extending between opposite axial end sides, for axially passing through melt material, wherein a lower axial end side 22 in FIGS. 1 and 2 is formed in a frustoconical manner and interacts with a valve seat 23 of the riser-duct shut-off valve 8, said valve seat 23 being formed by a mouth opening of a lower riser-duct portion 24 which is preferably configured in an arcuate manner in order to optimize the flow profile. This arcuate riser-duct portion 24 is realized in the example shown by a turn plug 25 provided with a corresponding arcuate bore, said turn plug 25 being fitted into an associated receiving bore 26 in the casting container 1 such that the arcuate riser-duct portion 24 is aligned on the inlet side with the casting-chamber outlet opening 5. At the other axial end side, remote from the valve seat 23, the valve body 20 ends with an end-side stop ring 27 which interacts in a manner limiting the valve stroke with a corresponding annular shoulder 28 of the riser-duct inner wall 21, i.e. in the case of a melt pressure force acting from below, the valve body 20 moves upward until it comes into abutment by way of its stop ring 27 with the annular shoulder 28 of the riser duct 4.

Figure 6:
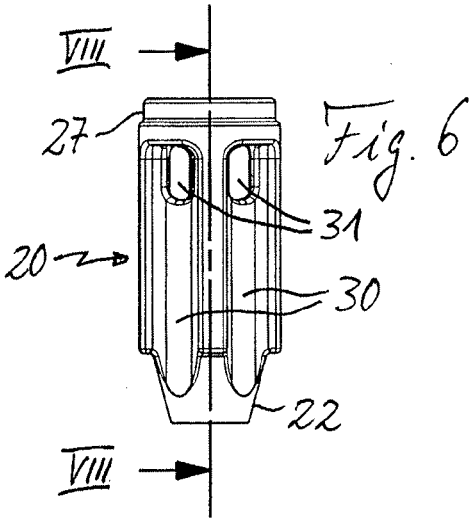
FIG. 6 shows a side view of a valve body of the riser-duct shut-off valve.
Figure 7:
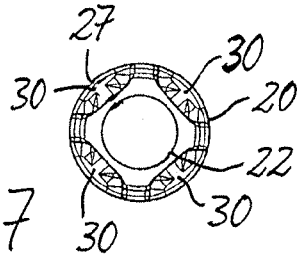
FIG. 7 shows a view from beneath of the valve body of the riser-duct shut-off valve.
Figure 8:
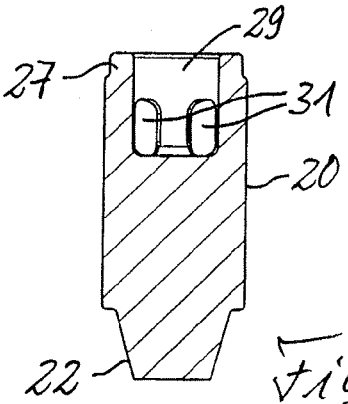
FIG. 8 shows a longitudinal sectional view along a line VIII-VIII in FIG. 6.

The stop ring 27 defines, i.e. surrounds, a central axial mouth opening 29 which forms an upper, outlet-side part of the duct structure of the valve body 20. Furthermore, as can be seen in more detail in conjunction with the individual illustrations of FIGS. 6 to 8, this duct structure contains a plurality of axial duct slots 30 arranged in a manner distributed around the outer circumference of the valve body, there being four slots 30 in the example shown, which extend from the valve-seat-side axial end side of the valve body 20 as far as the end-side stop ring 27. There, they open via a respective radial passage opening 31 of the duct structure into the central axial mouth opening 29.

The diameter of the mouth opening 29 is selected to be the same size as or larger than the diameter of the riser duct 4 in its portion upwardly adjoining the annular shoulder 28. This has the advantage that the stop ring 27 does not project radially into the riser duct 4 and therefore, with the riser-duct shut-off valve fully opened, see FIG. 2, no counterpressure can be exerted on the stop ring 27 via the valve body 20 by melt material in the riser duct 4. Rather, such a counterpressure is largely directed downward via the remaining connection of the mouth opening 29 via the passage openings 31 and the axial slots 30 and is absorbed by the valve seat 23 there or is redirected into a valve lifting force acting upwardly on the valve body 20. All that remains as counterpressure is a comparatively small force acting downwardly on the valve body surface in the region between the radial passage openings 31. In other words, the counterpressure effectively acts substantially only with the reduced cross-section of the mouth opening 29, while the entire effective cross section of the valve body 20, including its stop ring 27, is available for the upward pressure. Compared with the use of a conventional ball valve, this allows a considerably improved valve behavior.

To this end, FIG. 1 in turn shows the position of the riser-duct shut-off valve 8 during a melt suction operation. On account of the negative pressure forming in the casting chamber 17, the riser-duct shut-off valve 8 remains in the shown closed position in which it also drops under the force of gravity as soon as the melt material in the casting chamber 17 and in the riser duct 4 is relieved of pressure after the end of the mold-filling operation.

During a mold-filling operation, on account of the melt pressure in the casting chamber 17 and the following riser-duct portion 24, the valve body 20 of the riser-duct shut-off valve 8 lifts into its open position according to FIG. 2, in which the valve body 20 rests by way of its upper stop ring 27 against the riser-duct annular shoulder 28. In this position, melt material can flow upwardly in the riser duct 4, via the abovementioned duct structure, i.e. the axial slots 30, the radial passage openings 31 and the central axial mouth opening 29, through the valve body 20, and can be pressed from there in a conventional manner into a mold. Since the stop ring 27 rests completely against the riser-duct annular shoulder 28, the melt pressure force acts on the valve body 20, as explained above, over a smaller effective cross section from top to bottom than from bottom to top, and therefore still acts in an opening manner even when no or only a little melt volume is flowing. As a result, this riser-duct shut-off valve 8 also allows a small melt flow during the solidification phase toward the end of the mold-filling operation, as is desired for example in metal diecasting for compacting the metal melt material in the mold. In this period of the mold-filling operation, only very small melt volumes are delivered, which no longer produce any significant flow forces. A conventional ball valve would already close here, this being avoided by the present riser-duct shut-off valve. Only when pressure is relieved after the end of the mold-filling operation does the valve body 20 drop under the force of gravity onto the valve seat 23, with the result that the riser-duct shut-off valve 8 closes and prevents melt from flowing back downwardly in the riser duct 4 into the casting chamber 17.

In the example shown, the valve body 20 has a cylindrical shape. As a result, it can be supported against the riser-duct inner wall 21 over a relatively long axial length, thereby reliably avoiding undesired or operation-impairing wobbling movements or canting of the valve body 20. The duct structure 29, 30, 31 provides a defined throughflow of the valve body 20, with the result that the flow behavior of the melt material in the riser duct 4 can be optimized or can be kept largely unimpeded by the arrangement of the shut-off valve. Of course, alternative other configurations of the valve body for the riser-duct shut-off valve can be used, as long as the valve body fulfills the described functionalities according to the invention. This also applies for alternative configurations of the duct structure for the throughflow of this valve body with melt material to be delivered.

Figure 9:
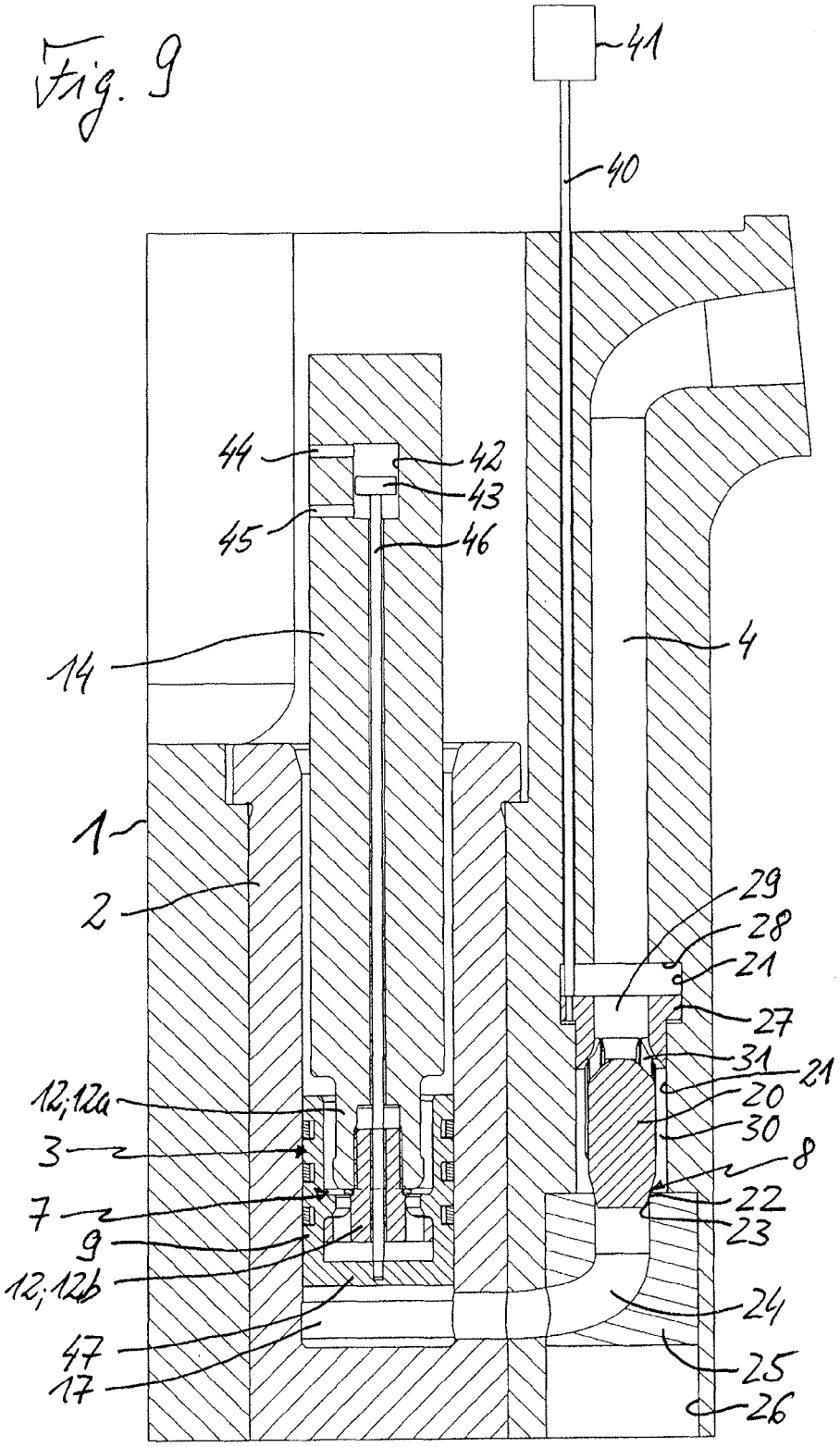
FIG. 9 shows a longitudinal sectional view of a casting unit corresponding to FIG. 1 for a variant having actively actuable shut-off valves.
Figure 10:
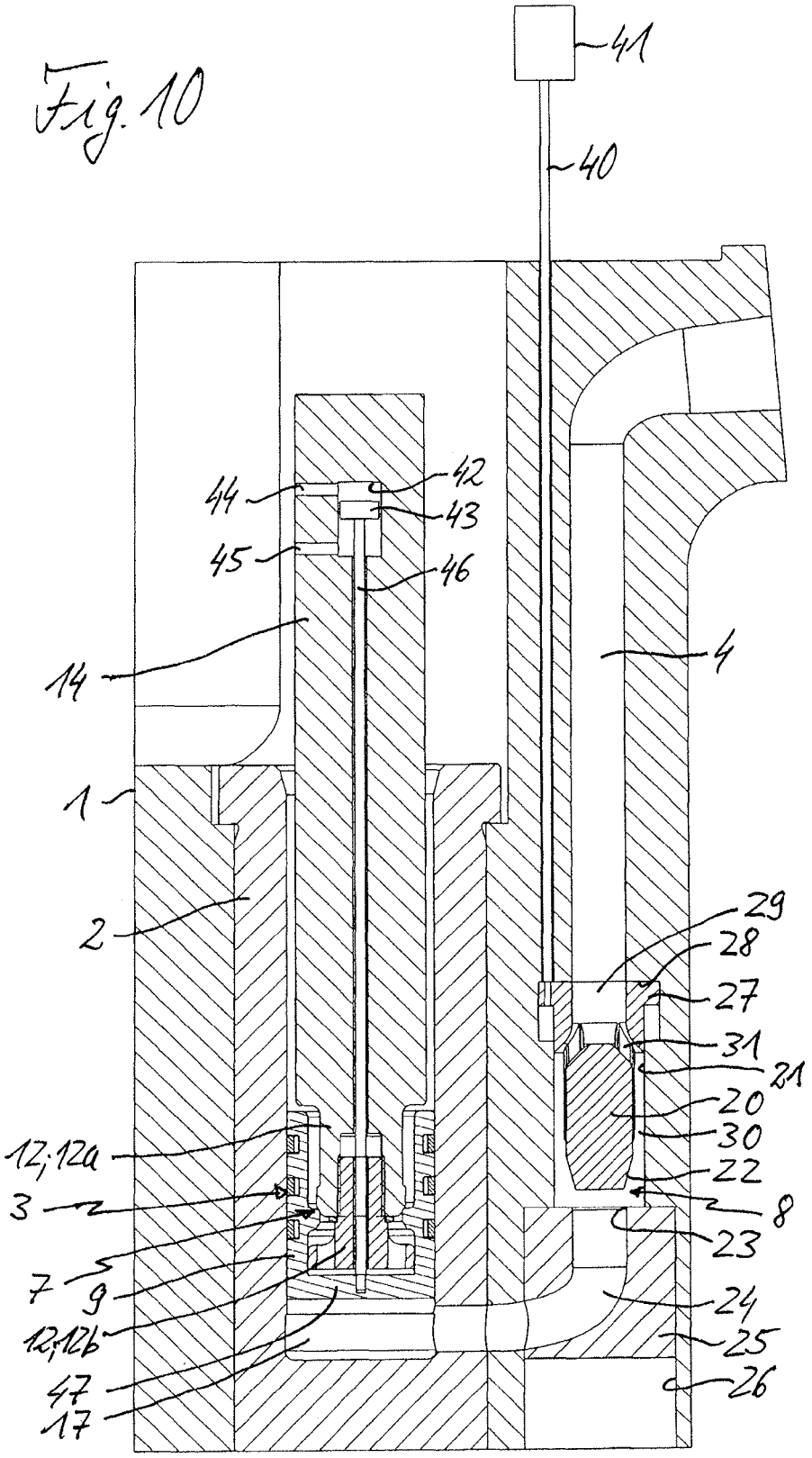
FIG. 10 shows a longitudinal sectional view of the casting unit from FIG. 9 with the valve positions corresponding to FIG. 2.

As is also apparent from the above description, the riser-duct shut-off valve shown in FIGS. 1, 2 and 6 to 8 is realized as a passively operating nonreturn valve. Realizations according to the invention as actively actuable valves are alternatively possible both for this valve 8 and for the shut-off valve 7 integrated into the casting plunger. FIGS. 9 and 10 to this end show an exemplary embodiment in which both valves are realized as actively controllable valves, here by way of example as a pneumatically or hydraulically or electromotively actuable valve. Alternatively, the invention of course also comprises embodiments in which one of the two valves is designed as a passively operating nonreturn valve and the other is designed as an actively actuable valve. For the sake of easier understanding, the same reference signs are used for identical or functionally equivalent components in the exemplary embodiment of FIGS. 9 and 10, which correspond to FIGS. 1 and 2, respectively, with regard to the valve positions, and reference can be made in this respect to the above explanations with regard to said components.

As can be seen from FIGS. 9 and 10, the casting unit shown there has a hydraulic or pneumatic actuator for the casting-plunger shut-off valve 7 and an electromotive actuator for the riser-duct shut-off valve 8. To this end, for the riser-duct shut-off valve 8, the valve body 20 is coupled at its upper stop ring 27, which is widened for this purpose, to a linear servomotor 41 via a control rod 40. The control rod 40 is guided through a corresponding through-passage bore in the casting container 1 next to the riser-duct bore 4 and is movable axially back and forth by the servomotor 41. As a result, the position of the valve body 20 in the riser duct 4 can be set actively, independently of the gravitation effects and melt pressure forces mentioned above for the case of the passive valve design. What was said above for the passive valve design applies analogously for the respectively desired valve positions.

The active actuability of the riser-duct shut-off valve 8 can be used, inter alia, to allow melt material to flow back out of the riser duct 4 into the casting chamber 17, if required, in that the valve 8 is opened, and to at least partially empty the riser duct 4, for example for maintenance or exchange work on the following mouthpiece. In the case of passive designs of the riser-duct shut-off valve 8, this on-request functionality can be realized for example in that a corresponding configuration of this valve 8 with regard to its sealing in the closed position ensures that melt material can flow back to the casting chamber 17 at a predefinable, low flowback rate via a defined flowback path from the riser duct 4 via the valve 8 in its closed position.

Shown for the casting-plunger shut-off valve 7 is a hydraulic or pneumatic actuator which is integrated into the plunger rod 14 and the casting plunger 3. A pressure space 42 is especially introduced into the plunger rod 14 for this purpose, said pressure space 42 being divided by a pressure plunger 43, wherein an associated pressure medium duct 44, 45 for each pressure-space half leads transversely out of the plunger rod 14. The pressure plunger 43 is coupled to a control rod 46 which extends axially centrally through the plunger rod 14 and the plunger ram 12 as far as a casting-plunger bottom 46, which in this exemplary embodiment ends the plunger sleeve 9 modified to this extent. The control rod 46 is fixed for example by a screw connection to the plunger-sleeve bottom surface 47, so that the plunger sleeve 9 is actively movable by a corresponding axial back and forth movement of the control rod 46 relative to the plunger ram 12. To this end, the two halves of the pressure chamber 42 are suitably subjected in a conventional manner to a positive or negative pressure of the associated pressure medium, such as air, some other gas or a fluid. In this way, the casting-plunger shut-off valve 7 can be actively moved between its open position and its closed position, additionally or alternatively to the valve actuating forces as occur in the case of the passive valve design explained above.

It goes without saying that, alternatively to the exemplary embodiments shown and described above, the invention also comprises embodiments in which the casting-plunger shut-off valve according to the invention and the riser-duct shut-off valve according to the invention are not both provided, but rather only one casting-plunger shut-off valve according to the invention or one riser-duct shut-off valve according to the invention is provided, while the in each case other valve is entirely missing or is replaced by a conventional valve known for this purpose. Thus, for example the casting plunger according to the invention having an integrated shut-off valve may also be used instead of a conventional casting plunger in a casting unit which has no or only one conventional shut-off valve in the riser line and does not require such a shut-off valve on account of a different structure. Likewise, in corresponding embodiments of the invention, only the riser-duct shut-off valve according to the invention may be provided for simultaneous use of a conventional casting plunger, for example for applications in which the melt flow into the casting chamber does not take place through the casting plunger but in some other way.

It also goes without saying that the casting plunger according to the invention and the casting unit according to the invention can be used not only in hot-chamber diecasting machines but also in other types of casting machines which are intended to be equipped with a casting plunger or a casting unit having such a functionality.

The invention claimed is:

1. A casting plunger for a casting unit of a casting machine, comprising:

a casting-plunger shut-off valve integrated into the casting plunger, having a valve seat and a valve body interacting therewith, wherein the shut-off valve, in an open position, enables a flow of melt material through the casting plunger during a melt suction operation and, in a closed position, blocks said flow during a mold-filling operation, wherein the casting plunger comprises a plunger sleeve, which is placeable against an inner wall of a casting cylinder of the casting unit and contains the valve seat, and a plunger ram which contains the valve body, wherein the plunger sleeve and the plunger ram are movable axially with respect to one another by a predefinable valve stroke, wherein the plunger ram comprises a first ram part having the valve body, and a second ram part, arranged on the first ram part, having a plunger sleeve driver stop; the second ram part being fastened at the first ram part, and wherein the second ram part comprises a disk body or cylinder body having a plurality of axial melt passage openings, and the axial melt passage openings extend through the disk or cylinder body.

2. The casting plunger as claimed in claim 1, wherein the valve stroke is settable in a variable manner.

3. The casting plunger as claimed in claim 1, wherein an axial distance of the plunger sleeve driver stop from the valve body is variably settable by the fixing of the second ram part to the first ram part.

4. The casting plunger as claimed in claim 1, wherein the casting-plunger shut-off valve is a passively operating non-return valve or actively controllable valve.

5. The casting plunger as claimed in claim 4, wherein the casting-plunger shut-off valve is a pneumatically, hydraulically, electromechanically or electromagnetically controllable valve.

6. A casting unit for a casting machine, comprising:

a casting container with a casting cylinder, and a casting plunger which is arranged in an axially movable manner in the casting cylinder, wherein the casting plunger comprises:

a casting-plunger shut-off valve integrated into the casting plunger, having a valve seat and a valve body interacting therewith, wherein the shut-off valve, in an open position, enables a flow of melt material through the casting plunger during a melt suction operation and, in a closed position, blocks said flow during a mold-filling operation, and a plunger sleeve, which is placeable against an inner wall of a casting cylinder of the casting unit and contains the valve seat, and a plunger ram which contains the valve body, wherein the plunger sleeve and the plunger ram are movable axially with respect to one another by a predefinable valve stroke, wherein the plunger ram comprises a first ram part having the valve body, and a second ram part, arranged on the first ram part, having a plunger sleeve driver stop; the second ram part being fastened at the first ram part, and wherein the second ram part comprises a disk body or cylinder body having a plurality of axial melt passage openings, and the axial melt passage openings extend through the disk or cylinder body.

7. A casting unit for a casting machine, comprising:

a casting container with a casting cylinder, and a casting plunger which is arranged in an axially movable manner in the casting cylinder, wherein the casting plunger comprises:

a casting-plunger shut-off valve integrated into the casting plunger, having a valve seat and a valve body interacting therewith, wherein the shut-off valve, in an open position, enables a flow of melt material through the casting plunger during a melt suction operation and, in a closed position, blocks said flow during a mold-filling operation, a plunger sleeve, which is placeable against an inner wall of a casting cylinder of the casting unit and contains the valve seat, and a plunger ram which contains the valve body, wherein the plunger sleeve and the plunger ram are movable axially with respect to one another by a predefinable valve stroke, a riser duct of the casting container, and a riser-duct shut-off valve in the riser duct, said riser-duct shut-off valve, in a closed position, blocking a flow of melt material through the riser duct during a melt suction operation and, in an open position, enabling said flow during a mold-filling operation, wherein the riser-duct shut-off valve has a valve body which is introduced in an axially movable manner into the riser duct and is supported against a riser-duct inner wall and contains a duct structure, extending between opposite axial end sides, for axially passing through melt material, wherein one of the two axial end sides of the valve body interacts with a valve seat of the shut-off valve.

8. The casting unit as claimed in claim 7, wherein the valve body is cylindrical and the axial end side of the valve body that is remote from the valve seat ends with an end-side stop ring which defines an axial mouth opening of the duct structure and interacts, in a manner limiting the valve stroke, with a corresponding annular shoulder of the riser-duct inner wall.

9. The casting unit as claimed in claim 8, wherein a diameter of the axial mouth opening is at least approximately as large as a riser-duct diameter reduced by the annular shoulder.

10. The casting unit as claimed in claim 8, wherein the duct structure comprises a plurality of axial duct slots arranged in a manner distributed around the outer circumference of the valve body, said duct slots extending from that axial end side of the valve body that faces the valve seat as far as the end-side stop ring and being connected there to the axial mouth opening via a respective radial through-passage opening.

11. The casting unit as claimed in claim 7, wherein the riser-duct shut-off valve is a passively operating nonreturn valve or an actively controllable valve.

12. The casting unit as claimed in claim 11, wherein the riser-duct shut-off valve is a pneumatically, hydraulically, electromechanically or electromagnetically controllable valve.

* * * * *